United States Patent [19]

Marshall

[11] 4,237,766

[45] Dec. 9, 1980

[54] HARMONICA

[76] Inventor: Michael A. Marshall, 3041 91st NE., Seattle, Wash. 98115

[21] Appl. No.: 30,063

[22] Filed: Apr. 16, 1979

[51] Int. Cl.[3] ..... G10D 7/12

[52] U.S. Cl. ..... 84/377

[58] Field of Search ..... 84/377, 378

[56] References Cited

U.S. PATENT DOCUMENTS

| | | | |
|---|---|---|---|
| 574,625 | 1/1897 | Paris | 84/377 |
| 863,960 | 8/1907 | Yates | 84/377 |
| 882,575 | 3/1908 | Murphy | 84/377 |
| 1,676,154 | 7/1928 | Perry | 84/377 |
| 1,735,645 | 11/1929 | Hostetter | 84/377 |
| 2,276,501 | 3/1942 | Manieri | 84/377 |
| 2,511,302 | 6/1950 | Stephenson | 84/377 |
| 4,069,735 | 1/1978 | Bertram | 84/474 |

*Primary Examiner*—Lawrence R. Franklin
*Attorney, Agent, or Firm*—Michael Toner

[57] ABSTRACT

An harmonica having a conventional body shaped so as to form a series of adjacent cavities and a plurality of reeds each of which is responsive to the passage of air to produce an audible musical note of a certain fixed pitch. Two reeds are associated with each cavity such that one reed is responsive to blowing into the cavity to produce a blownote and the other is responsive to drawing on such cavity to produce a drawnote. In one embodiment, the reeds are constructed and arranged such that the blownotes include the first, fourth and sixth notes of the major scale of a keynote and all the drawnotes are notes of the major scale of that keynote. Harmonicas utilizing modal scales are also provided.

24 Claims, 7 Drawing Figures

FIG. 5B

| | | | | | | | | | | | |
|---|---|---|---|---|---|---|---|---|---|---|---|
| | C | F | A | C | E | G | A | C | E | G | |
| (f) | □ | □ | □ | □ | □ | □ | □ | □ | □ | □ | F |
| | $B^b$ | D | F | $B^b$ | D | F | $B^b$ | D | F | $B^b$ | |
| | $C^\#$ | $F^\#$ | $A^\#$ | $C^\#$ | $E^\#$ | $G^\#$ | $A^\#$ | $C^\#$ | $E^\#$ | $G^\#$ | |
| (g) | □ | □ | □ | □ | □ | □ | □ | □ | □ | □ | $F^\#$ |
| | B | $D^\#$ | $F^\#$ | B | $D^\#$ | $F^\#$ | B | $D^\#$ | $F^\#$ | B | |
| | D | G | B | D | $F^\#$ | A | B | D | $F^\#$ | A | |
| (h) | □ | □ | □ | □ | □ | □ | □ | □ | □ | □ | G |
| | C | E | G | C | E | G | C | E | G | C | |
| | $E^b$ | $A^b$ | C | $E^b$ | G | $B^b$ | C | $E^b$ | G | $B^b$ | |
| (i) | □ | □ | □ | □ | □ | □ | □ | □ | □ | □ | $A^b$ |
| | $D^b$ | F | $A^b$ | $D^b$ | F | $A^b$ | $D^b$ | F | $A^b$ | $D^b$ | |
| | E | A | $C^\#$ | E | $G^\#$ | B | $C^\#$ | E | $G^\#$ | B | |
| (j) | □ | □ | □ | □ | □ | □ | □ | □ | □ | □ | A |
| | D | $F^\#$ | A | D | $F^\#$ | A | D | $F^\#$ | A | D | |
| | F | $B^b$ | D | F | A | C | D | F | A | C | |
| (k) | □ | □ | □ | □ | □ | □ | □ | □ | □ | □ | $B^b$ |
| | $E^b$ | G | $B^b$ | $E^b$ | G | $B^b$ | $E^b$ | G | $B^b$ | E | |
| | $F^\#$ | B | $D^\#$ | $F^\#$ | $A^\#$ | $C^\#$ | $D^\#$ | $F^\#$ | $A^\#$ | $C^\#$ | |
| (l) | □ | □ | □ | □ | □ | □ | □ | □ | □ | □ | B |
| | E | $G^\#$ | B | E | $G^\#$ | B | E | $G^\#$ | B | E | |

HARMONICA

FIELD OF THE INVENTION

This invention relates to harmonicas, mouth organs and related musical instruments.

BACKGROUND OF THE INVENTION

Three general types of harmonicas have achieved popularity: simple harmonicas, concert harmonicas and chromatic harmonicas. Simple harmonicas typically consist of ten holes or cavities each of which can produce two notes, one drawnote and one blownote. Concert harmonicas have two parallel rows of holes with the reeds in the upper holes tuned one octave higher than those of the lower holes. Both simple and concert harmonicas are tuned to and constructed for a particular key. Chromatic harmonicas, on the other hand, consist in effect of two separate harmonicas, one above the other, in which one instrument is tuned a semitone higher than the other, making it possible to play a single chromatic harmonica in different keys. Chromatic harmonicas, however, suffer from the limitation that players must hunt notes one at a time, and fast chordal groupings are difficult or impossible to play.

In addition to these traditional harmonica types, many specialized harmonicas have been proposed in the prior art. Such specialized harmonicas include those with replaceable reed members with reeds arranged according to preset melodies (U.S. Pat. Nos. 2,595,381 and 2,595,382); harmonicas having means for sharping or flatting the notes (U.S. Pat. Nos. 2,190,633; 2,192,983; and 2,565,100); and harmonicas having means for changing keys (U.S. Pat. Nos. 2,744,434 and 3,580,125). For the most part, such harmonicas are overly specialized and complex, and have not achieved wide-spread acceptance.

The simple ten hole harmonica is a chordal instrument in which the progression of notes (for each key) has long been standardized. The progression, more fully described below, is such that exhaling or blowing across any three adjacent holes will produce a major triad of the keynote and the dominant triad is found by inhaling or drawing. However, other chords are generally unavailable, and the harmonica therefore has a limited range, particularly for improvising and for accompanying many different types of music. In addition, prior simple harmonicas have not been adapted for modal use, a limitation which has further restricted their versatility.

SUMMARY OF THE INVENTION

The present invention provides a harmonica in which the reeds are constructed and arranged in such a way that the majority of the limitations of prior simple harmonicas are overcome.

The harmonica has a conventional body shaped so as to form a series of adjacent cavities or holes, and a plurality of reeds each of which is responsive to the passage of air to produce an audible musical note of a certain fixed pitch. Two reeds are associated with each cavity such that one reed is responsive to blowing into such cavity to produce a blownote, and the other is responsive to drawing on such cavity to produce a drawnote. In one preferred embodiment, the reeds are constructed and arranged such that the blownotes include the first, fourth and sixth notes of the major scale of a keynote, and all the drawnotes are notes of the major scale of the keynote. Harmonicas of the present invention also include other embodiments adapted for modal use. Such other embodiments are similar to the embodiment described above, except that the drawnotes and blownotes are selected from the Dorian, Phrygian, Lydian, Aeolian and Locrian scales of the keynote.

These and other features and advantages of the present invention will be apparent from the following detailed description taken in conjunction with the accompanying drawings.

BRIEF DESCRIPTION OF THE DRAWINGS

FIGS. 5A and 5B illustrate the particular note arrangements of harmonicas according to the present invention for twelve different keynotes;

DETAILED DESCRIPTION OF THE INVENTION

Figure 1:
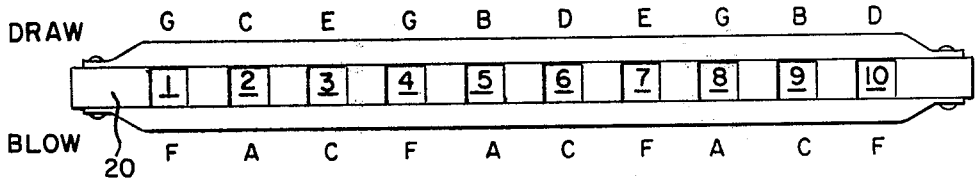
FIG. 1 illustrates a harmonica of the present invention for the key of C.

FIG. 1 schematically illustrates a simple ten hole harmonica according to the present invention for the keynote of C. The harmonica has a conventional overall structure comprising a body 20 containing ten aligned holes or cavities 1–10. Two reeds of a conventional type (not shown) are associated with each hole such that one reed is responsive to blowing air into the hole and the other is responsive to drawing air from it. Each reed is constructed so that in response to blowing or drawing it produces a musical note or tone of a certain fixed pitch. The notes indicated along the upper portion of FIG. 1 are those produced by drawing on the respective holes, and are termed drawnotes. The notes indicated along the lower portion of FIG. 1 are the corresponding blownotes.

Figure 2:
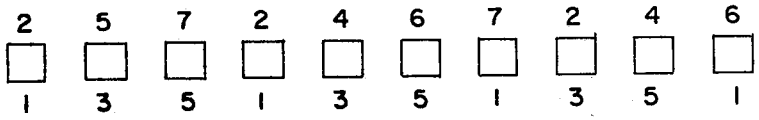
FIG. 2 illustrates the note arrangement of a conventional simple harmonica.

Referring now to FIG. 2, this figure schematically illustrates the ten cavities of a simple ten hole harmonica such as the one shown in FIG. 1. The number above each cavity represents the drawnote associated with that cavity, whereas the numbers below the cavities represent the blownotes. In FIG. 2, the numbers 1–7 represent the first through seventh notes of the major scale of any keynote. The note sequence shown in FIG. 2 is that of a conventional prior art harmonica. For example, a conventional F harmonica has the following note sequence:

| | | | | | | | | | | |
|---|---|---|---|---|---|---|---|---|---|---|
| DRAW: | G | C | E | G | B♭ | D | E | G | B♭ | D |
| BLOW: | F | A | C | F | A | C | F | A | C | F |

Comparing this note sequence with FIG. 2, it is seen that F=1, G=2, A=3, $B^6$=4, and so forth. The note positions of FIG. 2, however, represent a conventional harmonica of any keynote, so long as the numbers 1–7 are taken to refer to the major scale of that keynote. It will be noticed that any three adjacent blownotes will produce the major triad of the keynote, and that the first four drawnotes will produce the major triad of the dominant of that keynote. Other chordal groupings, however, are generally unavailable, and the range of conventional simple harmonicas is therefore quite limited.

Figure 3:
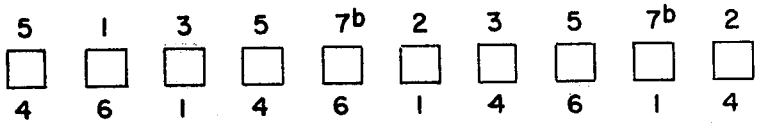
FIG. 3 represents the crossharp note arrangement of a simple harmonica.

Many modern harmonica players, in order to achieve greater range, have by ear adopted a new perspective of the notes of the conventional simple harmonica. This new perspective is called crossharp and is illustrated in FIG. 3. FIG. 3 represents a harmonica identical to the one shown in FIG. 2, but in FIG. 3 the numbers 1–7 represent the major scale of the dominant of the keynote. Thus for the F harmonica shown above, 1 represents C (the dominant of F), 2=D and so forth. Since the C major scale includes B and not $B^6$, the seventh note is flatted where it appears in FIG. 3. It is emphasized that FIGS. 2 and 3 represent the same harmonica, viewed from different perspectives. The crossharp perspective of FIG. 3 is used primarily for blues and rhythmical jazz. It is less useful that the straight harp of FIG. 2 for playing melodies. In general, straight harp accents the blownotes, and crossharp accents the drawnotes.

Figure 4:
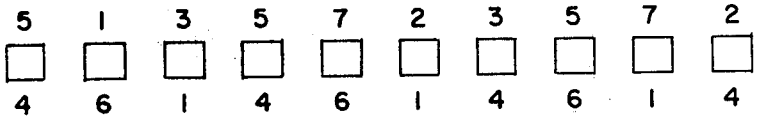
FIG. 4 represents the generalized note arrangement of one embodiment of the present invention.
Figure 5A:
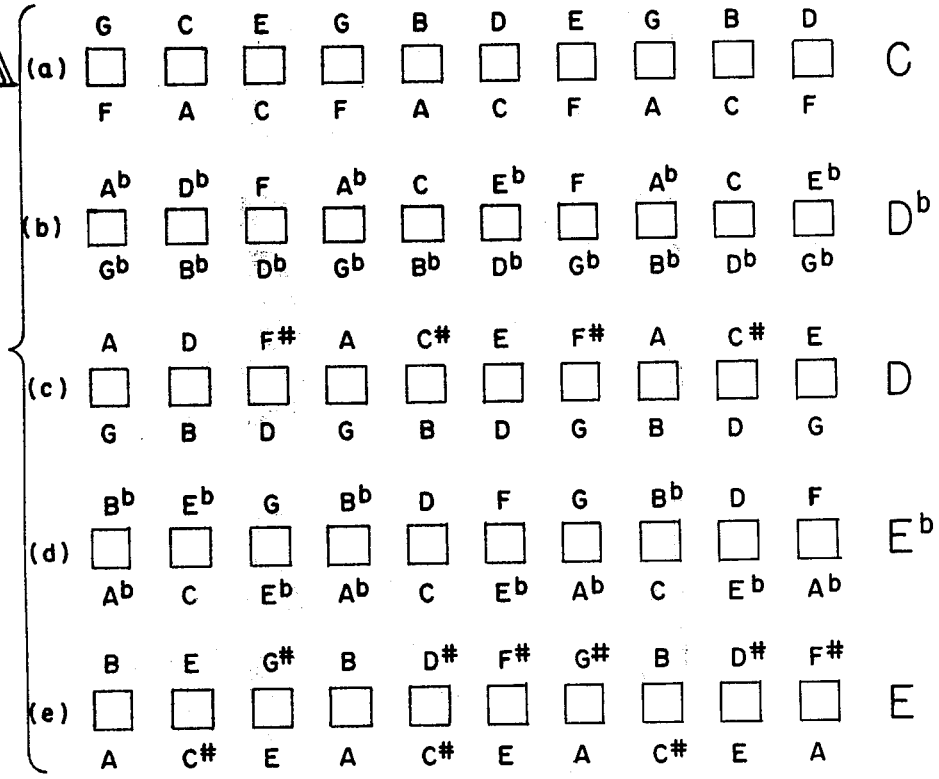

FIG. 4 illustrates the note sequence of harmonicas according to one embodiment of the present invention. In FIG. 4, the numbers 1–7 represent the notes of a major scale of the note represented by the number 1. FIG. 1 illustrates such a harmonica for the particular case C=1. The note sequence is unlike that of any prior harmonica. Taking note 1 as the keynote, the blownotes include the first, fourth and sixth notes of the major scale of the keynote, and all the drawnotes are notes of the major scale of the keynote. This is in contrast to a conventional harmonica played crossharp, where the drawnotes include a non-natural tone, the seven flat. With harmonicas of the present invention, exhaling across any three notes will produce a 4 chord and the dominant of the keynote is found by inhaling. Other available chords include a 3 chord (3-5-7), a 3 seventh chord (3-5-7-2), a 5 chord (5-7-2) and a 5 six chord (5-7-2-3). These new chords considerably expand the range of the harmonica, and make it very useful for improvisation. FIGS. 5A and 5B illustrate the particular harmonica of FIG. 4 for each of the twelve possible keynotes. In each case, the keynote is shown at the far right of each figure portion.

Harmonicas according to the present invention also include those whose note arrangements are adapted for playing in different musical modes. The idea of modal use is very fundamental to improvisation techniques and is a powerful tool for giving color and atmosphere to music. As is known by those skilled in the art, the different musical modes may be defined either in terms of upward or downward shifts of the notes of a major scale, or in terms of a particular sequence of intervals between notes. For example, the Ionian mode utilizes the conventional major scale in which the intervals between adjacent notes expressed as whole steps (1) or half steps ($\frac{1}{2}$), is as follows:

| | | | | | | | |
|---|---|---|---|---|---|---|---|
| Ionian: | 1 | 1 | ½ | 1 | 1 | 1 | ½ |

A musical scale based on such intervals is herein referred to as a major or Ionian scale. Similarly, scales in other modes are defined as follows:

| | | | | | | | |
|---|---|---|---|---|---|---|---|
| Dorian: | 1 | ½ | 1 | 1 | 1 | ½ | 1 |
| Phrygian: | ½ | 1 | 1 | 1 | ½ | 1 | 1 |
| Lydian: | 1 | 1 | 1 | ½ | 1 | 1 | ½ |
| Aeolian: | 1 | ½ | 1 | 1 | ½ | 1 | 1 |
| Locrian: | ½ | 1 | 1 | ½ | 1 | 1 | 1 |

Figure 6:
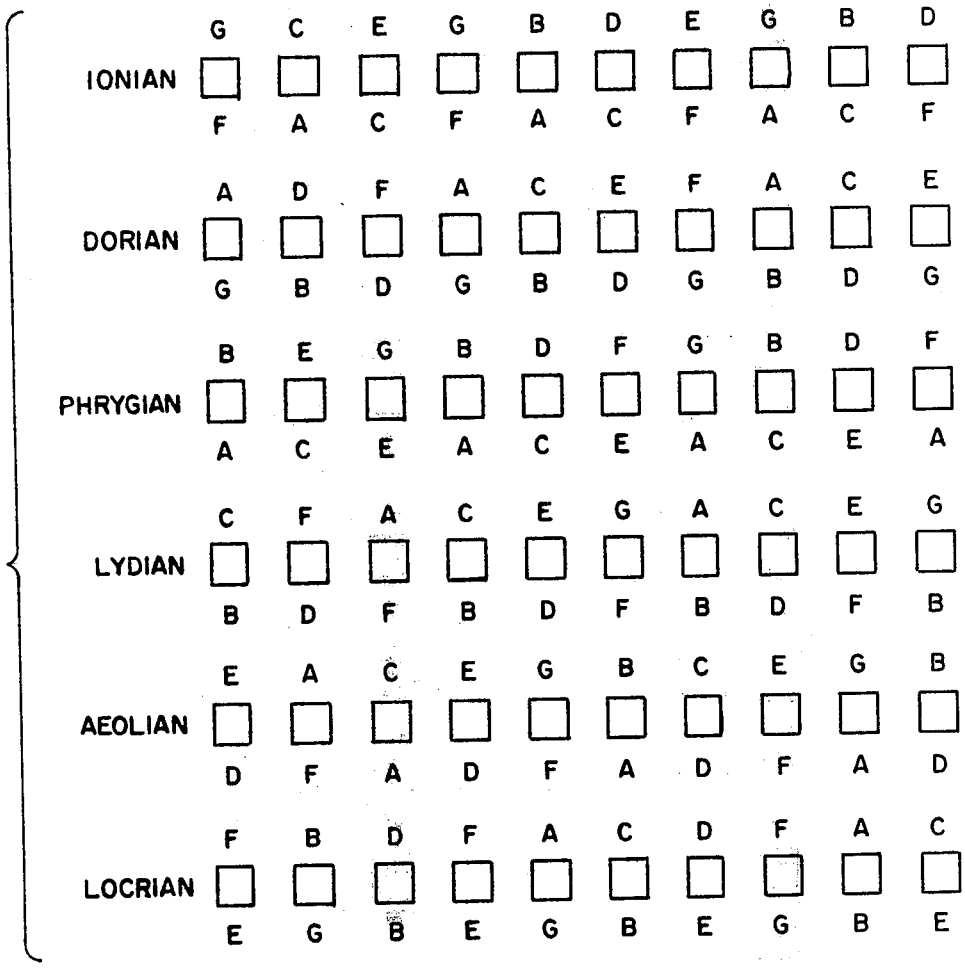
FIG. 6 represents the note arrangements of harmonicas of the present invention for six different modes for the key of C.

FIG. 6 illustrates the note arrangements for harmonicas of the present invention for the key of C for the Ionian, Dorian, Phrygian, Lydian, Aeolian, and Locrian modes. Since the Ionian mode is equivalent to our conventional major scale, FIG. 6(*a*) is identical to FIGS. 1 and 5(*a*). By straightforward application of the modal definitions set forth above, harmonicas of the present invention for the modes shown in FIG. 6 can be derived for any of the harmonicas of FIG. 5. All of such harmonicas would be adapted for playing or accompanying music in a particular mode and would provide the player all of the chords set forth previously, namely a 3 chord, a 3 seven chord, a 5 chord, and a 5 six chord, as well as the modal triads of the keynote and its dominant. Note that each of the harmonicas of FIG. 6 has a different keynote, the keynote in each case being the second drawnote or the third blownote (see FIG. 4).

The application of the expanded chordal combinations of the present invention to the various modes provides an almost umlimited freedom for improvisation and for novel musical effects, and also allows the harmonica to play with a sound not heretofore associated with that instrument. It further allows almost complete freedom as to the kinds of music the harmonica can accompany. The use of the different modal harmonicas of the present invention will not, however, require a relearning process for the musician for each mode, since in a given key, the breath patterns will be transferable for all modes in that key. Thus a player's unique characteristics will be unaltered despite the fact that a different mode will infuse the music with a vastly different feeling and color.

While the prefered embodiments of the invention have been illustrated and described herein, it should be understood that variations and alternatives will be apparent to those skilled in the art. Accordingly, the invention is not to be limited to the specific embodiment illustrated and described herein, and the scope and spirit of the invention are to be understood by reference to the following claims.

What is claimed is:

1. A harmonica comprising a body shaped so as to form a series of adjacent cavities and further comprising a plurality of reeds each of which is responsive to the passage of air to produce an audible musical note of a certain pitch, two reeds being associated with each cavity such that one reed is responsive to blowing into such cavity to produce a blownote and the other is responsive to drawing on such cavity to produce a drawnote, the reeds being constructed and arranged such that the blownotes include the first, fourth and sixth notes of the major scale of a keynote, and all drawnotes are notes of the major scale of the keynote.

2. The harmonica of claim 1, wherein the blownotes include only the first, fourth and sixth notes of the major scale of the keynote.

3. The harmonica of claim 1, wherein the drawnotes include the first, second, third, fifth and seventh notes of the major scale of the keynote.

4. The harmonica of claim 1, wherein the body comprises ten cavities, wherein the sequence of drawnotes associated with sequentially adjacent cavities is five-one-three-five-seven-two-three-five-seven-two, wherein the sequence of blownotes associated with such cavities is four-six-one-four-six-one-four-six-one-four respectively, wherein the numbers one through seven refer to the first through seventh notes respectively of the major scale of the keynote.

5. A harmonica comprising a body shaped so as to form a series of adjacent cavities and further comprising a plurality of reeds each of which is responsive to the passage of air to produce an audible musical note of a certain pitch, two reeds being associated with each cavity such that one reed is responsive to blowing into such cavity to produce a blownote and the other is responsive to drawing on such cavity to produce a drawnote, the reeds being constructed and arranged such that the blownotes include the first, fourth and sixth notes of the Dorian scale of a keynote, and all drawnotes are notes of the Dorian scale of the keynote.

6. The harmonica of claim 5, wherein the blownotes include only the first, fourth and sixth notes of the Dorian scale of the keynote.

7. The harmonica of claim 5, wherein the drawnotes include the first, second, third, fifth and seventh notes of the Dorian scale of the keynote.

8. The harmonica of claim 5, wherein the body comprises ten cavities, wherein the sequence of drawnotes associated with sequentially adjacent cavities is five-one-three-five-seven-two-three-five-seven-two, wherein the sequence of blownotes associated with such cavities is four-six-one-four-six-one-four-six-one-four respectively, wherein the numbers one through seven refer to the first through seventh notes respectively of the Dorian scale of the keynote.

9. A harmonica comprising a body shaped so as to form a series of adjacent cavities and further comprising a plurality of reeds each of which is responsive to the passage of air to produce an audible musical note of a certain pitch, two reeds being associated with each cavity such that one reed is responsive to blowing into such cavity to produce a blownote and the other is responsive to drawing on such cavity to produce a drawnote, the reeds being constructed and arranged such that the blownotes include the first, fourth and sixth notes of the Phrygian scale of a keynote, and all drawnotes are notes of the Phrygian scale of the keynote.

10. The harmonica of claim 9, wherein the blownotes include only the first, fourth and sixth notes of the Phrygian scale of the keynote.

11. The harmonica of claim 9, wherein the drawnotes include the first, second, third, fifth and seventh notes of the Phrygian scale of the keynote.

12. The harmonica of claim 9, wherein the body comprises ten cavities, wherein the sequence of drawnotes associated with sequentially adjacent cavities is five-one-three-five-seven-two-three-five-seven-two, wherein the sequence of blownotes associated with such cavities is four-six-one-four-six-one-four-six-one-four respectively, wherein the numbers one through seven refer to the first through seventh notes respectively of the Phrygian scale of the keynote.

13. A harmonica comprising a body shaped so as to form a series of adjacent cavities and further comprising a plurality of reeds each of which is responsive to the passage of air to produce an audible musical note of a certain pitch, two reeds being associated with each cavity such that one reed is responsive to blowing into such cavity to produce a blownote and the other is responsive to drawing on such cavity to produce a drawnote, the reeds being constructed and arranged such that the blownotes include the first, fourth and sixth notes of the Lydian scale of a keynote, and all drawnotes are notes of the Lydian scale of the keynote.

14. The harmonica of claim 13 wherein the blownotes include only the first, fourth and sixth notes of the Lydian scale of the keynote.

15. The harmonica of claim 13, wherein the drawnotes include the first, second, third, fifth and seventh notes of the Lydian scale of the keynote.

16. The harmonica of claim 13, wherein the body comprises ten cavities, wherein the sequence of drawnotes associated with sequentially adjacent cavities is five-one-three-five-seven-two-three-five-seven-two, wherein the sequence of blownotes associated with such cavities is four-six-one-four-six one-four-six-one-four respectively, wherein the numbers one through seven refer to the first through seventh notes respectively of the Lydian scale of the keynote.

17. A harmonica comprising a body shaped so as to form a series of adjacent cavities and further comprising a plurality of reeds each of which is responsive to the passage of air to produce an audible musical note of a certain pitch, two reeds being associated with each cavity such that one reed is responsive to blowing into such cavity to produce a blownote and the other is responsive to drawing on such cavity to produce a drawnote, the reeds being constructed and arranged such that the blownotes include the first, fourth and sixth notes of the Aeolian scale of a keynote, and all drawnotes are notes of the aeolian scale of the keynote.

18. The harmonica of claim 17 wherein the blownotes include only the first, fourth and sixth notes of the Aeolian scale of the keynote.

19. The harmonica of claim 17, wherein the drawnotes include the first, second, third, fifth and seventh notes of the Aeolian scale of the keynote.

20. The harmonica of claim 17, wherein the body comprises ten cavities, wherein the sequence of drawnotes associated with sequentially adjacent cavities is five-one-three-five-seven-two-three-five-seven-two, wherein the sequence of blownotes associated with such cavities is four-six-one-four-six- one-four-six-one-four respectively, wherein the numbers one through seven refer to the first through seventh notes respectively of the Aeolian scale of the keynote.

21. A harmonica comprising a body shaped so as to form a series of adjacent cavities and further comprising a plurality of reeds each of which is responsive to the passage of air to produce an audible musical note of a certain pitch, two reeds being associated with each cavity such that one reed is responsive to blowing into such cavity to produce a blownote and the other is responsive to drawing on such cavity to produce a drawnote, the reeds being constructed and arranged such that the blownotes include the first, fourth and sixth notes of the Locrian scale of a keynote, and all drawnotes are notes of the Locrian scale of the keynote.

22. The harmonica of claim 21 wherein the blownotes include only the first, fourth and sixth notes of the Locrian scale of the keynote.

23. The harmonica of claim 21, wherein the drawnotes include the first, second, third, fifth and seventh notes of the Locrian scale of the keynote.

24. The harmonica of claim 21, wherein the body comprises ten cavities, wherein the sequence of drawnotes associated with sequentially adjacent cavities is five-one-three-five-seven-two-three-five-seven-two, wherein the sequence of blownotes associated with such cavities is four-six-one-four-six one-four-six-one-four respectively, wherein the numbers one through seven refer to the first through seventh notes respectively of the Locrian scale of the keynote.

* * * * *